US005997391A

United States Patent [19]

Jaeggi

[11] Patent Number: 5,997,391

[45] Date of Patent: Dec. 7, 1999

[54] DEVICE FOR THE CONTINUOUS AND FINE REPROFILING IN SITU OF THE SURFACE OF THE HEAD OF AT LEAST ONE RAIL OF A RAILWAY TRACK

[75] Inventor: Jean-Pierre Jaeggi, Geneva, Switzerland

[73] Assignee: Speno International SA, Geneva, Switzerland

[21] Appl. No.: 08/944,446

[22] Filed: Oct. 6, 1997

[30] Foreign Application Priority Data

Dec. 20, 1996 [CH] Switzerland ..... 3150/96

[51] Int. Cl.[6] ..... B24B 23/00

[52] U.S. Cl. ..... 451/429; 451/347

[58] Field of Search ..... 451/429, 347, 451/296, 303

[56] References Cited

U.S. PATENT DOCUMENTS

| | | | |
|---|---|---|---|
| 4,115,857 | 9/1978 | Panetti . | |
| 4,492,059 | 1/1985 | Panetti . | |
| 4,548,070 | 10/1985 | Panetti . | |
| 4,615,150 | 10/1986 | Panetti . | |
| 4,843,765 | 7/1989 | Panetti . | |
| 4,905,422 | 3/1990 | Panetti . | |
| 5,031,365 | 7/1991 | Arndt et al. . | |
| 5,567,196 | 10/1996 | Theurer | 451/347 |
| 5,575,709 | 11/1996 | Hertelendi et al. | 451/347 |
| 5,735,734 | 4/1998 | Hertelendi | 451/347 |

FOREIGN PATENT DOCUMENTS

| | | | |
|---|---|---|---|
| 0 371 328 | 6/1990 | European Pat. Off. . | |
| 000444242 | 9/1991 | European Pat. Off. | 451/347 |
| 000484303 | 5/1992 | European Pat. Off. | 451/296 |
| 0 512 159 | 11/1992 | European Pat. Off. . | |
| 000512159 | 11/1992 | European Pat. Off. | 451/347 |
| 2 655 670 | 6/1991 | France . | |
| 356 483 | 10/1961 | Switzerland . | |
| 606 616 | 11/1978 | Switzerland . | |
| 626 673 | 11/1981 | Switzerland . | |
| 633 336 | 11/1982 | Switzerland . | |
| 653 073 | 12/1985 | Switzerland . | |
| 654 047 | 1/1986 | Switzerland . | |
| 655 528 | 4/1986 | Switzerland . | |
| 670 667 | 6/1989 | Switzerland . | |

*Primary Examiner*—David A. Scherbel
*Assistant Examiner*—Daniel G. Shanley
*Attorney, Agent, or Firm*—Young & Thompson

[57] ABSTRACT

A fine grinding device for the continuous reprofiling in situ of the surface of the head of at least one rail of a railway track includes at least one fine grinding unit per rail. Each one of these fine grinding units carries a beam (1) on which are mounted rotatably at least two pulleys (4, 8) situated slightly above the rail (3) and around which is arranged an endless abrasive brand (5) working in the longitudinal direction of the rail. Between these two pulleys (4) there is a biasing shoe (12) that contacts the rail over a rectangular surface and that is subjected to the action of a jack supported by the beam (1) and acting on the shoe (12) with a determined force for applying the abrasive band (5) against the head of the rail (3) without any vibration. At least one of the pulleys (4) is driven in rotation by a motor to set the abrasive band (5) into motion.

12 Claims, 8 Drawing Sheets

DEVICE FOR THE CONTINUOUS AND FINE REPROFILING IN SITU OF THE SURFACE OF THE HEAD OF AT LEAST ONE RAIL OF A RAILWAY TRACK

BACKGROUND OF THE INVENTION

The present invention is concerned with devices for the continuous reprofiling by grinding of the surface of the head of one or both rails of a railway track, in situ. Several reprofiling installations mounted on or pulled by railway carriages have been proposed to this day, such as those described for example in the patents CH 606 616; CH 626 673; CH 633 336; CH 653 073; CH 654 047; CH 655 528.

All these conventional grinding devices have in common the fact that they include at least one grinding unit, which has means for guiding it along the rail; means for coupling it to a frame of a railway carriage for its pulling along the railway track; means for moving the grinding unit vertically with respect to the frame and for applying the same against the rail to be reprofiled; and members pressing against the rail to define a reference base of a length sufficient for ensuring that the positioning the grinding unit on the rail be substantially independent of the undulations to be eliminated from the rail; a grinding tool; and means for driving this grinding tool in one or several movements relative to the grinding unit and hence to the rail to be reprofiled.

These installations for reprofiling a rail by grinding differ, on the one hand, by the practical realization of the means and members cited above that they carry and, on the other hand, by the grinding means they use, which can be abrasive shoes, lapping grinders, peripheral grinders or cutters.

The most serious drawback of these known devices, in particular those using rotatory tools such as grinders, resides in the fact that the accuracy of the reprofiling is not sufficient, in particular for the rails used by high speed trains.

FIGS. 1 to 3 and 4 to 6 illustrate schematically the influence of the slack in the bearings of the motor driving the peripheral grinder or the lapping grinder on the quality of fine reprofiling. This slack in the bearings of the driving shaft of the grinder causes oscillations thereof which produce micro-undulations on the head of the reprofiled rail (FIGS. 3 and 6).

One can show that, for oscillations of the grinding axis in the order of 0.25 mm, the undulations or micro-undulations produced on the tread of the rail can exhibit a depth in the order of 0.1 mm and a length between 18 and 20 mm.

These micro-undulations cause annoyance by the noise they produce during the passage of trains, at a frequency in the order of 1200 Hz for trains running at 100 km/hr, and which can extend beyond 3000 Hz for trains running at 250 km/hr.

This phenomenon of creations of micro-undulations on the tread of the head of the rail occurs in all cases, whatever the device used for reprofiling using a rotatory tool in contact with the rail, may it be a grinder or a cutter. These deformations of the rail are clearly illustrated in the plan view of FIGS. 2 and 5 and in the longitudinal cross-sectional view of FIGS. 3 and 6.

One can see that this phenomenon of creation of micro-undulations along the surface of the rail occurs when the reprofiling thereof is carried out by means of shoes or scrapers in contact with the rail.

At the present time, the reprofiling of the rail by means of abrasive shoes subjected to a continuous or an alternating motion in the direction of the longitudinal axis of the rail is completely abandoned because the abrading capacity, i.e. of the capacity of these shoes to remove the metal, is totally insufficient and the rail cannot be used by trains for an excessive duration of time.

The use of an abrasive web for the reprofiling of the rails has also been proposed, but these attempts have not been satisfactory. Patent CH 356 483 describes a reprofiling device in which an abrasive web is held taught under a shoe provided with running rollers at its ends. The abrasive web is fixed, the portion in contact with the rail can be replaced by a new portion manually when worn. Patent EP 0 512 159 describes a device for grinding the rail including a continuous abrasive web, held around rollers, of which three are in contact with the rail. These two devices in CH 356 483 and EP 0 512 159 have the same drawback as the devices discussed previously, since they include wheels or rollers applying the abrasive web against the rail, and accordingly these rollers exhibit necessarily some slack and this produces necessarily micro-undulations on the surface of the rail.

Patent EP 0 371 328 describes a device for grinding a rail by means of a continuous abrasive web, closed on itself and driven by this motor. This abrasive web moves along a plane perpendicular to the longitudinal axis of the rail, which necessitates the use of lower rollers on which passes the abrasive web which are placed laterally with respect to the rail and slightly lower that the rail tread. This is a serious drawback since such a device cannot be pulled along the railway track without having to be frequently lifted to avoid the obstacles found along the rail.

Thus, no solution proposed at this time for the reprofiling and the grinding of the rail has been capable of avoiding the creation or of eliminating the micro-undulations formed along the tread surface and which can induce unacceptable noise levels, when a train travels at high speed.

SUMMARY OF THE INVENTION

The present invention is aimed at providing a fine grinding device which makes it possible to remove the micro-undulations produced on the tread of a rail by reprofiling operations of the rail. Furthermore, this fine grinding device must be capable of carrying out this fine grinding operation while being pulled along a rail by a railway carriage at a speed similar to the speed of presently existing reprofiling machines and not exhibit members extending laterally on each side of the rail and which would enter into collision with obstacles along the rail.

The present invention is aimed at a grinding device, including an abrasive web, which is closed on itself and driven into motion in a plane substantially parallel to the longitudinal axis of the rail, and which is capable of being mounted on a railway carriage to be pulled along the railway track and thus allow a continuous fine grinding or polishing of the tread of the rail, to remove the micro-undulations due to rotatory tools used for reprofiling the rail.

BRIEF DESCRIPTION OF THE DRAWINGS

The appended drawing illustrates schematically and by way of example two embodiments of the fine grinding device for the tread of a rail of a railway track.

DESCRIPTION OF THE PREFERRED EMBODIMENT

The solution proposed by the present invention for the in situ reprofiling of rails consists in reprofiling the rails by means of a conventional machine for grinding rails, and thereafter carry out a fine grinding by means of a fine grinding device, according to the present invention, using an abrasive web, this fine grinding device being carried and pulled, if desired, by the same railway vehicle as that used for pulling the grinding machine.

Figure 1:
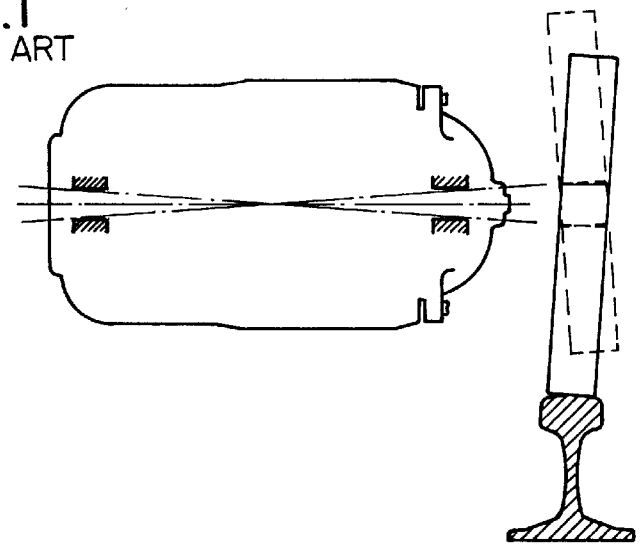
FIG.1 PRIOR ART
FIGS. 1 and 4 illustrate schematically a tangential grinder, and a lapping grinder, respectively, with the their drive motor and they illustrate the unbalance of the grinder caused by the slack of the bearings of the shaft of the grinder.
Figure 2:
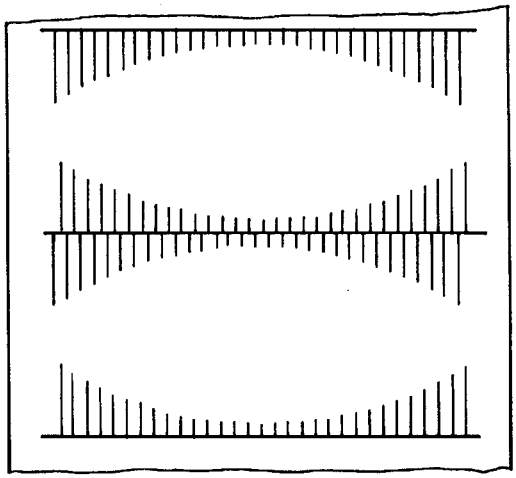
FIG.2 PRIOR ART
FIGS. 2, 5 and 3, 6 are, respectively, top views and longitudinal cross-sectional views illustrating schematically the tread of a rail on which micro-undulations have been created by the defective rotation of grinders.
Figure 3:
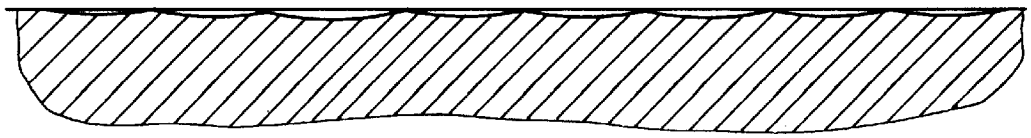
FIG.3 PRIOR ART
Figure 4:
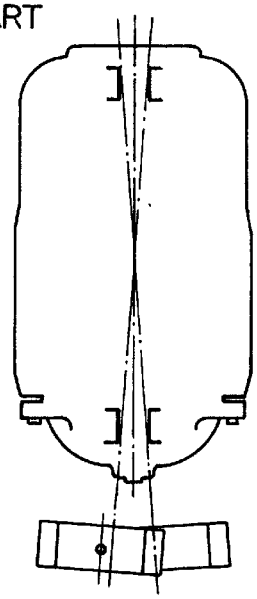
FIG. 4 PRIOR ART
Figure 5:
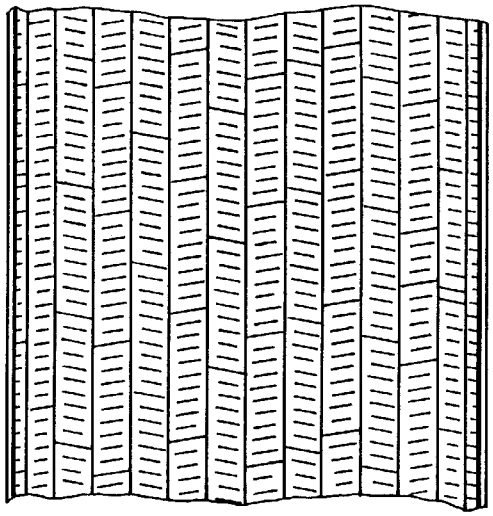
FIG. 5 PRIOR ART
Figure 6:
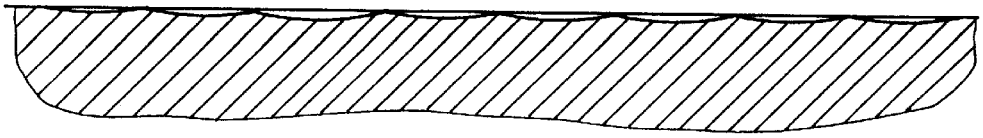
FIG. 6 PRIOR ART
Figure 8:
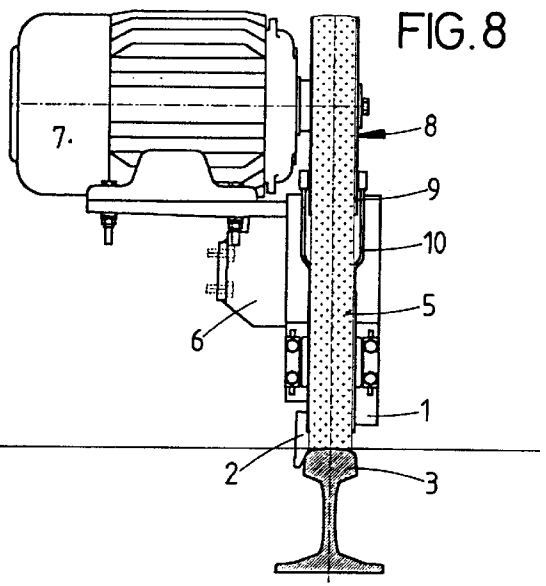
FIG. 8 is a view from A of FIG. 7.
Figure 7:
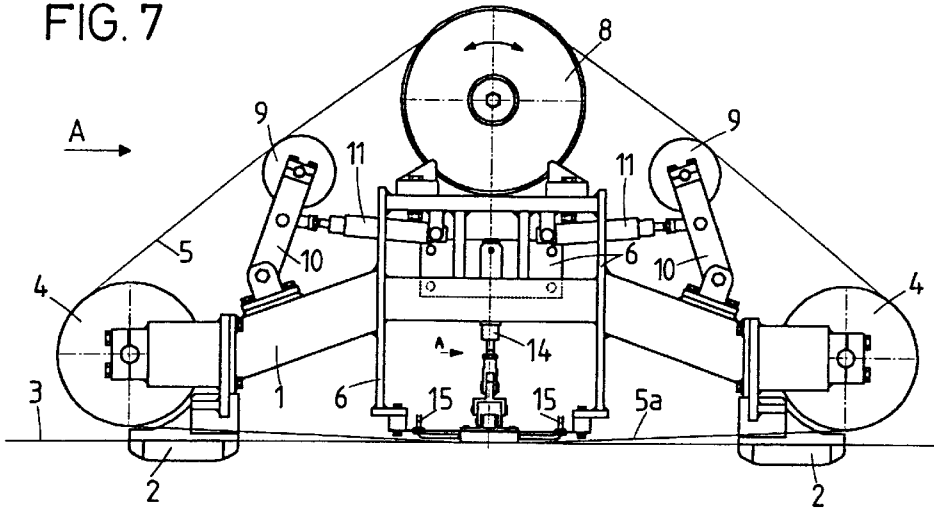
FIG. 7 is a side view of the fine grinding device according to the invention.
Figure 9:
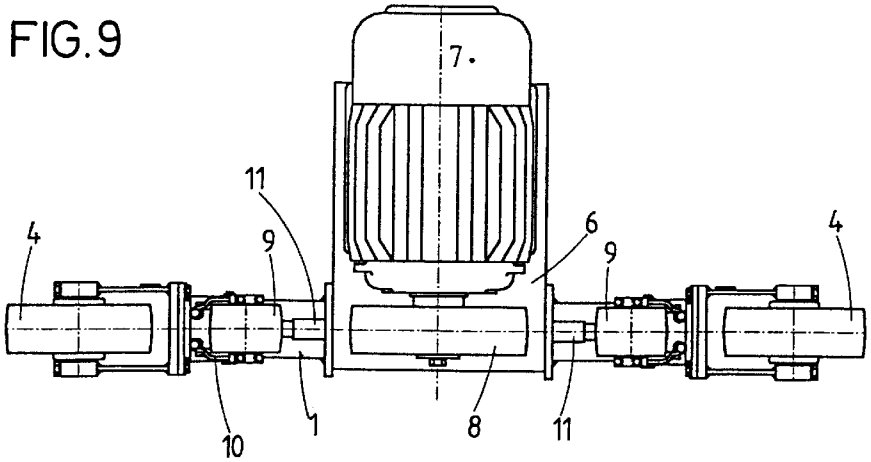
FIG. 9 is a view from beneath of the device illustrated in FIG. 7.

The fine grinding device illustrated in FIGS. 7 to 9 includes a longitudinal beam 1 carrying at each one of its ends a guiding shoe 2 in its working position, in contact with the upper and lateral inner face of the head 3 of the rail. The ends of the longitudinal beam 1 each carry one roller 4 having a peripheral surface which is slightly concave. These rollers 4 are designed for cooperating with an endless abrasive web 5, but never come in contact with the rail.

The longitudinal beam 1 carries in its central part a frame 6, of which the upper part acts as a support to its motor 7 driving a pulley 8 designed for cooperating with the endless abrasive web 5.

The endless abrasive web 5 runs around the rollers 4 and the pulley 8 which drives it in rotation. This endless web 5 is subjected to the action of tensioning rollers 9 carried by the end of the arms 10 linked to the lateral portions of the longitudinal beam 1 and subjected to the action of the hydraulic jacks 11.

Figure 10:
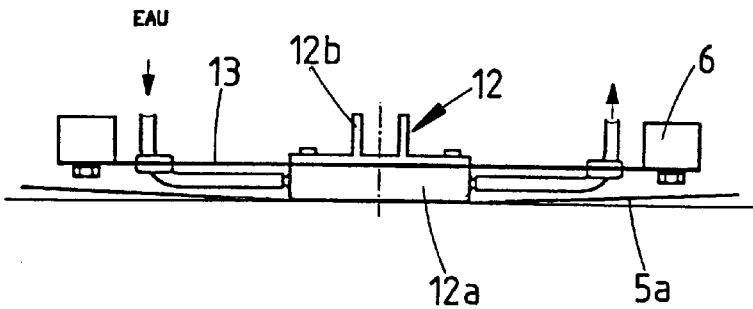
FIG. 10 is a detailed view, at a larger scale, of the shoe biasing against the abrasive web illustrated in FIG. 7.

The lower part of the frame 6 carries a biasing shoe 12. As can be seen in FIG. 10, the biasing shoe 12 has a lower part 12*a* under the surface of which the abrasive web 5 slides. This lower part 12*a* is situated beneath a flexible blade 13 and is fastened thereto by bolts on the upper part 12*b* of the biasing shoe 12. The flexible steel blade 13, nipped between the parts 12*a* and 12*b* of the shoe 12, is fastened by its ends to the frame 6.

The upper part 12*b* of this shoe 12 is connected to the frame 6 by a hydraulic jack 14, making it possible, when the device is fastened under the railway carriage as will be seen further, to apply the shoe 12 and hence the endless abrasive web 5 against the tread of the head 3 of the rail with a determined force. This jack acts also as a shock absorber, such that the shoe 12 be applied continuously without vibrations or oscillations and with a constant force, against the rail.

Generally, the drive of the abrasive web 5 is provided for in such a manner that the run 5*a* of this web 5 in contact with the rail moves in the same direction as that in which the railway carriage progresses along the rail, so as to facilitate the removal of the metal filings or dust produced from the rail.

The support shoe 12 includes an integrated cooling system supplied with a cooling fluid via a conduit 15. This makes it possible, should the temperature of the abrasive web exceed a value fixed in advance, cause its cooling to avoid any deterioration and decrease of its abrasive power.

Owing to this construction, the abrasive web 5 is applied against the rail by means of a shoe 12 without vibrations and none of its rotatory driving members comes in contact with the rail, which makes it possible to remove completely any residual micro-undulations left on the tread of the rail by the reprofiling grinders.

Figure 11:
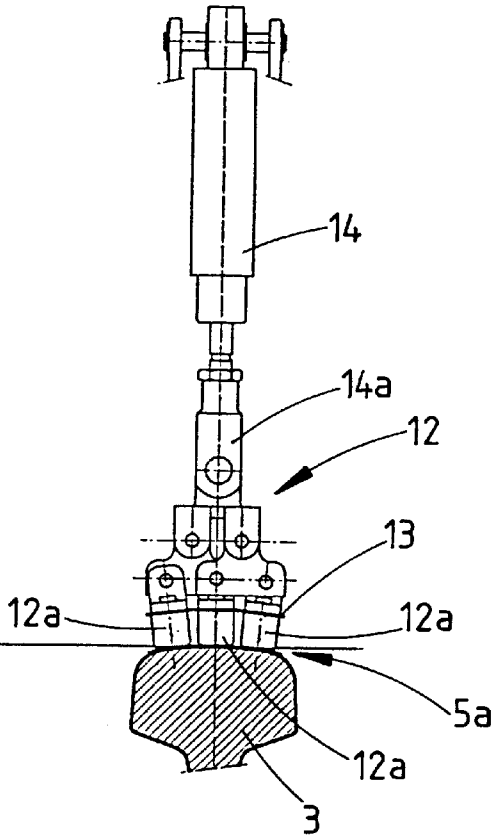
FIG. 11 illustrates an articulated shoe biasing against the abrasive web.

FIG. 11 illustrates another version of the biasing shoe 12 in which its lower part 12*a* is divided longitudinally into three parts. These three lower parts 12*a* are fastened via the flexible blade 13 to the upper parts 12*b* linked together and with the rod 14*a* of the pressure jack in such a manner that under the pressure of the jack 14, the lower parts 12*a* of the shoe 12 adapt to the concave surface of the tread, in such a manner as to apply the adhesive web uniformly over the whole surface of the tread of the head 3 of the rail.

The biasing shoe 12 and, in particular, its lower parts 12*a*, can be made from a special material, resistant to both heat and friction, for example from ceramic.

Figure 12:
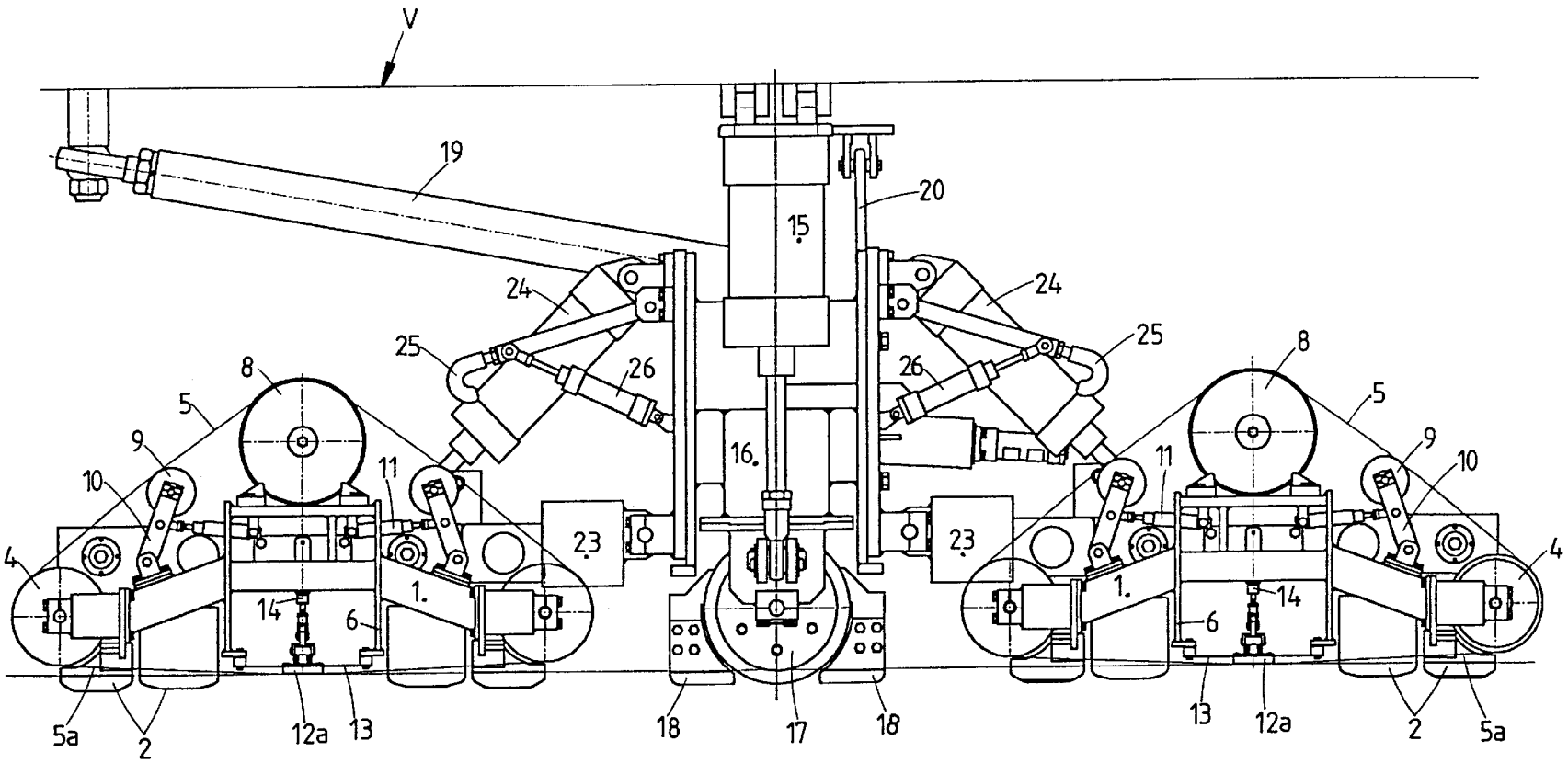
FIGS. 12 and 13 illustrate the mounting of four devices such as illustrated in FIG. 7, under a railway carriage.
Figure 13:
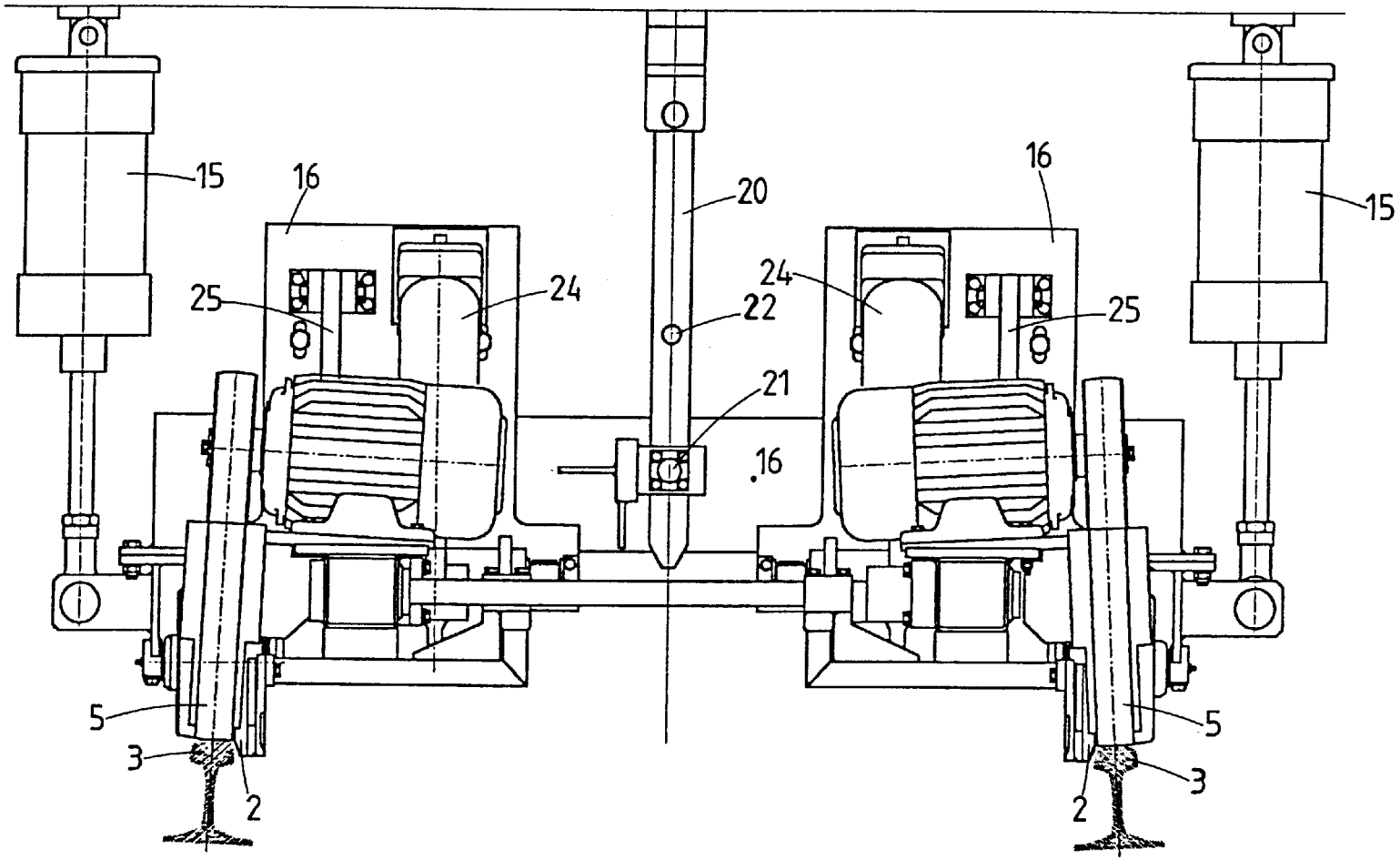

FIGS. 12 and 13 show how four units such as those described with reference to FIGS. 7 to 9, two for each rail, are mounted under the railway vehicle V.

The two lifting jacks 15 are fastened to each side of the frame of the railway vehicle V and carry a moving frame 16 including two wheels 17 designed for running along the rails, as well as stops 18 cooperating with the inner face of the head 3 of the rails.

The movable frame 16 is also connected to the vehicle V by means of a drawbar 19. In this manner, the movable frame 16 can be pulled along the rail or be lifted therefrom and maintained in a lifted position by means of a rod 20 and of a pin 21, inserted into a hole 22 of this rod.

The movable frame 16 has supports 23 on which the grinding units are mounted pivotally by means of jacks 24. When the fine grinding units are pivoted into their high position, they can be maintained in this non operative position by means of hooks 25 actuated by the jacks 26, and then the four fine grinding units are lifted into their lifted position by the jacks 15.

In the working position illustrated in FIGS. 12 and 13, the support 16 is in its low position, with the wheels 17 resting on the rails and the fine grinding units being held in their working positions, by means of the guiding shoes 2. In this position, the abrasive web 5 is pressed against the rail 3 by the biasing shoes 12, via the the pushing action the jacks 14.

To set the fine grinding units into the working position on the rails, spacer devices are provided to space apart the opposite fine grinding devices, in such a manner as to apply the guiding shoes 2 against the inner face of the rails 3.

Similarly, tilting devices are provided for tilting the fine grinding units by a predetermined angle so that the same be located in the plane of symmetry of each rail. These spacer and tilting devices are of the same type as those used for positioning the grinding units and will not be described here in detail.

Figure 14:
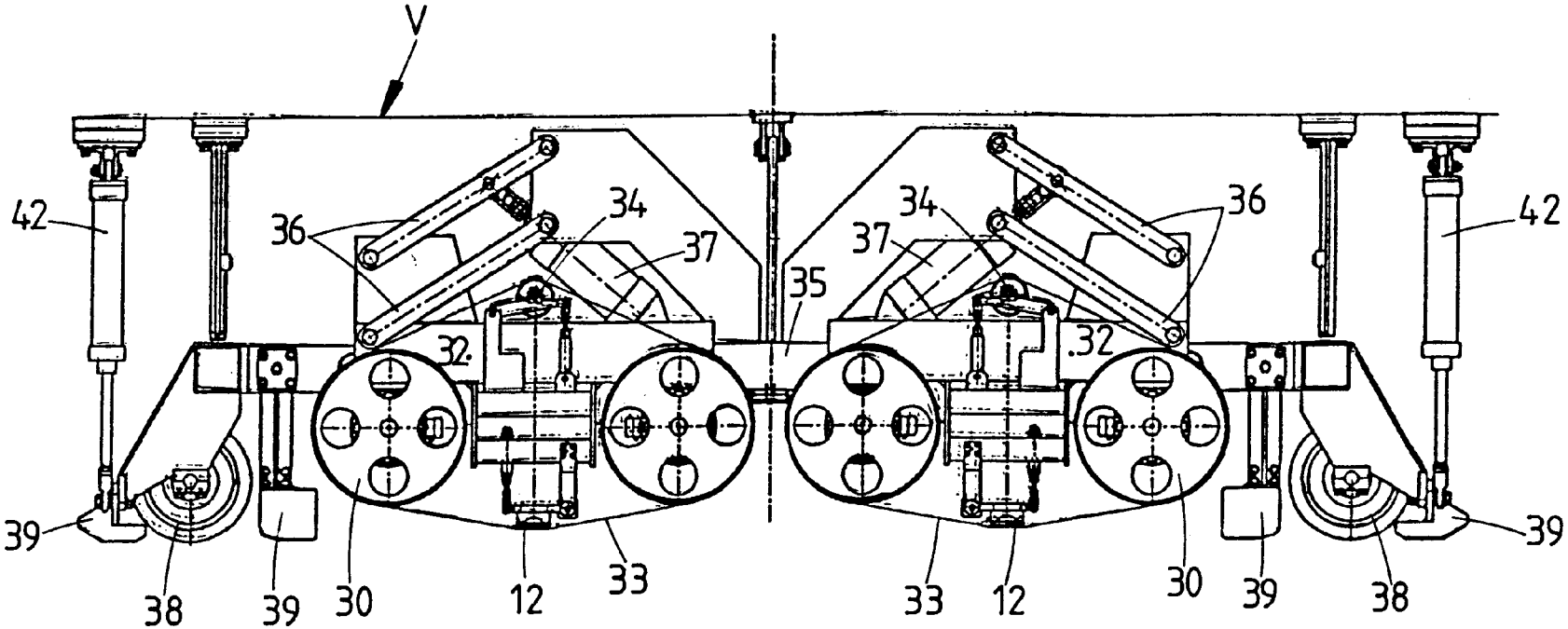
FIGS. 14 and 15 are views similar to FIGS. 12 and 13, of a second embodiment of the fine grinding device and its mounting on a railway carriage.
Figure 15:
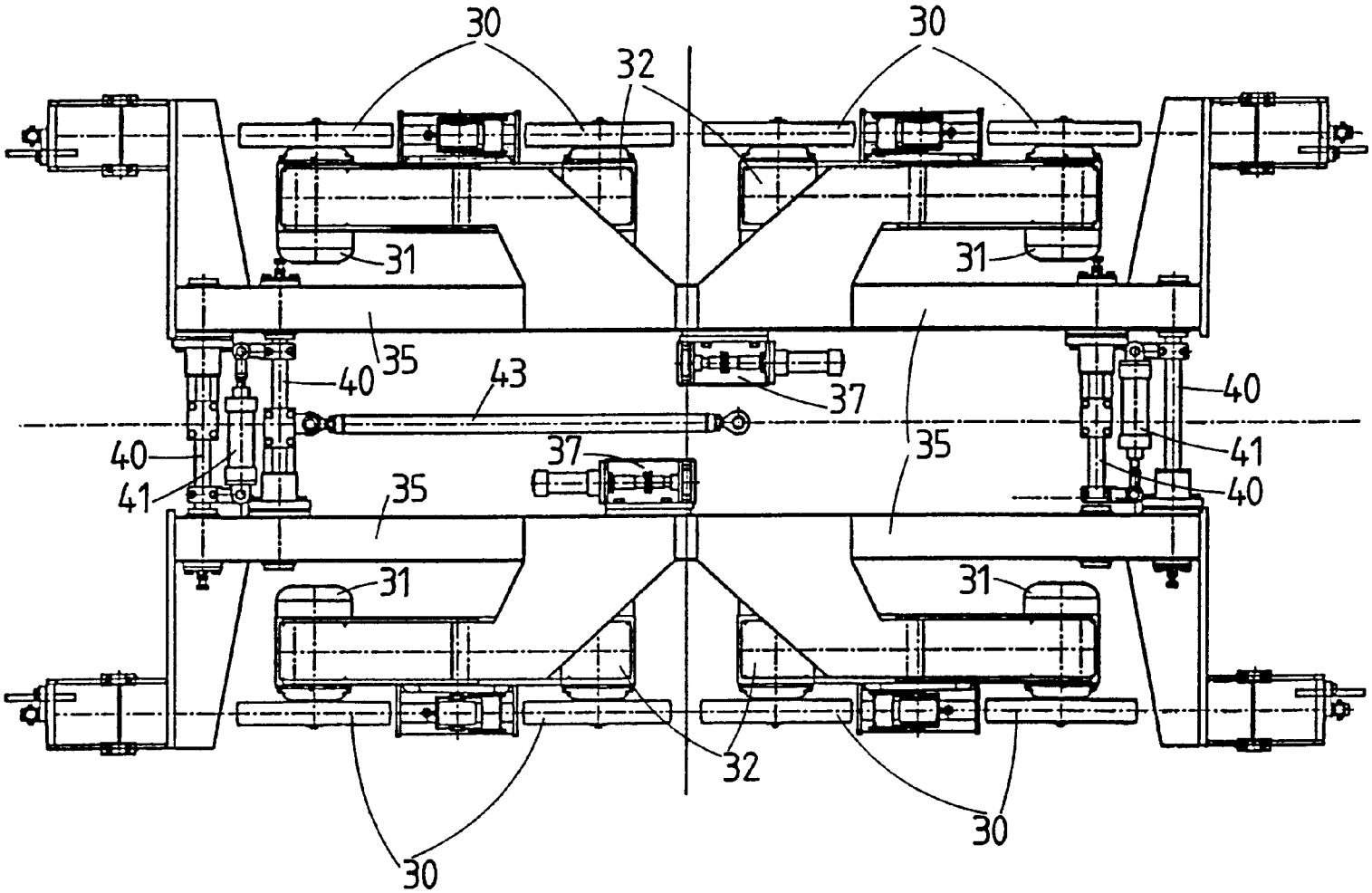

In the second embodiment, illustrated in FIGS. 14 and 15, each fine grinding unit includes two pulleys 30 driven each one by a motor 31, mounted on a beam 32. An endless abrasive web 33 surrounds these two pulleys 30, is subjected to the action of a tensioning pulley 34 and passes over a biasing shoe 12 as in the first embodiment. The beam 32, carrying the fine grinding unit, is connected to a undercarriage 35 by connecting rods 36 providing a deformable parallelogram actuated by a jack 37 for lifting the unit.

The undercarriage 35 is provided with pulleys 38 running on the rails, guiding stops 39 and a spacer device including guides 40 and jacks 41 connecting the two opposite halves of the undercarriage 35 carrying each one two fine grinding units.

This undercarriage 35 is connected, on the one hand, to a railway carriage V by the lifting jacks 42 and, on the other hand by a drawbar 43.

In the two embodiments, the two pairs of rollers 4 or pulleys 30, of the abrasive web 5, 33 are lifted with respect to the plane of operation, so as not to enter in contact with the rail and facilitate the passage over offset junctions of the rails. The biasing shoe 12 is situated in a median position between these two rollers 4, 30, which ensures the same efficacy in the two directions of operation of the railway vehicle V, along the railway track.

No rotatory part of the fine grinding units is in contact or biases against the rail.

In the two embodiments, the fine grinding units are mounted pivotally between a working position and a non operative position on their support, which support biases against the rail via rollers in the working position. This support is, furthermore, connected to the railway vehicle by means of a drawbar and of lifting jacks.

I claim:

1. A device for the in situ continuous fine reprofiling of a surface of at least one rail of a railway track, including four fine grinding units that each include a beam on which are mounted rotatably at least two pulleys for being situated slightly above a rail when the device is operating and around which is arranged an endless abrasive web for moving in a longitudinal direction of a rail when the device is operating, wherein between two of the pulleys there is a biasing shoe subjected to the action of a jack supported by said beam and for acting on the biasing shoe with a force to bias the abrasive web against a rail when the device is operating, without any vibration, wherein at least one of the pulleys is driven in rotation by a motor to drive the abrasive web into motion, and wherein each of said fine grinding units is mounted tiltably on a central support that is carried by two lifting jacks and a drawbar.

2. A device for the in situ continuous fine reprofiling of a surface of at least one rail of a railway track, including at least one fine grinding unit that includes a beam on which are mounted rotatably at least two pulleys for being situated slightly above a rail when the device is operating and around which is arranged an endless abrasive web for moving in a longitudinal direction of a rail when the device is operating, wherein between two of the pulleys there is a biasing shoe subjected to the action of a jack supported by said beam and for acting on the biasing shoe with a force to bias the abrasive web against a rail when the device is operating, without any vibration, wherein at least one of the pulleys is driven in rotation by a motor to drive the abrasive web into motion, wherein said biasing shoe comprises a lower part biasing the abrasive web and an upper part connected to the jack, wherein said lower and upper parts are fastened together and hold firmly therebetween a flexible blade, the ends of which are attached to a frame fastened to the beam.

3. A device for in situ continuous reprofiling of a surface of a rail of a railway track, the device having at least one fine grinding unit which comprises:

a biasing shoe with at least one rectangular surface at a first level that is at a level of a rail of a railway track when the device is operating;

a jack connected to said biasing shoe and exerting a biasing force on said biasing shoe;

at least two pulleys separated by said biasing shoe and a motor for driving at least one of said at least two pulleys, peripheries of said at least two pulleys being spaced from said first level;

an endless abrasive band that is rotatably mounted around said at least two pulleys and said biasing shoe, said band being movably pressed onto a rail of a railway track by said rectangular surface when the device is operating; and a beam carrying said jack and said at least two pulleys.

4. The device according to claim 3, wherein said biasing shoe is provided with a cooling circuit.

5. The device according to claim 3, wherein the biasing shoe is made of a special material capable of resisting heat and friction.

6. The device of claim 3, wherein said biasing shoe comprises at least two of said rectangular surfaces that are not coplanar.

7. The device of claim 3, comprising three of said pulleys, wherein two of said three pulleys are at ends of said beam and said jack is arranged generally perpendicular to a line joining centers of said two pulleys at the ends of said beam.

8. The device of claim 7, wherein a third of said three pulleys is carried by said beam opposite said jack and is driven by said motor.

9. The device of claim 7, wherein the peripheries of both of said two pulleys at the ends of said beam are spaced from said first level by a first distance.

10. The device of claim 7, further comprising two tensioning rollers connected to said beam with further jacks that urge said two tensioning rollers against said endless abrasive band.

11. The device of claim 3, wherein said biasing shoe is also flexibly affixed to a frame attached to said beam.

12. The device of claim 3, comprising a central support tiltably mounting four of said fine grinding units.

* * * * *